US006030760A

United States Patent [19]

Shuttleworth et al.

[11] Patent Number: 6,030,760

[45] Date of Patent: Feb. 29, 2000

[54] PHOTOGRAPHIC ELEMENT CONTAINING SPECIFIC MAGENTA COUPLER AND ANTI-FADING AGENT

[75] Inventors: Leslie Shuttleworth, Webster, N.Y.; Michael W. Crawley, Watford, United Kingdom; Stanley W. Cowan, Rochester, N.Y.

[73] Assignee: Eastman Kodak Company, Rochester, N.Y.

[21] Appl. No.: 09/134,118

[22] Filed: Aug. 14, 1998

[51] Int. Cl.[7] ..... G03C 1/08; G03C 7/26; G03C 7/32

[52] U.S. Cl. ..... 430/551; 430/558; 430/372

[58] Field of Search ..... 430/543, 558, 430/551, 372

[56] References Cited

U.S. PATENT DOCUMENTS

| | | | |
|---|---|---|---|
| 4,338,393 | 7/1982 | Bailey et al. | 430/558 |
| 5,143,821 | 9/1992 | Crawley et al. | 430/558 |
| 5,236,819 | 8/1993 | Kadokura et al. | 430/551 |
| 5,561,037 | 10/1996 | Jain et al. | 430/551 |
| 5,776,669 | 7/1998 | Crawley et al. | 430/558 |
| 5,876,912 | 3/1999 | Crawley et al. | 430/558 |

*Primary Examiner*—Geraldine Letscher
*Attorney, Agent, or Firm*—Arthur E. Kluegel

[57] ABSTRACT

The disclosure describes a photographic element comprising a support on which is coated at least one green-sensitized silver halide emulsion layer having associated therewith at least one magenta dye-forming coupler of Formula (1*a*) and at least one compound of Formula (2)

(1a)

wherein:

$R_1$ is an alkyl group;

$R_5$, $R_6$, $R_7$, and $R_8$ each independently represent a hydrogen atom or a substituent;

Z is a hydrogen atom or a group that can be split off by the reaction of the coupler with an oxidized color-developing agent;

(2)

wherein:

$Z_1$ and $Z_2$ are alkylene groups of 1–3 carbon atoms;

R is an aryl or heterocyclic group, and q is 1 or 2.

19 Claims, No Drawings

PHOTOGRAPHIC ELEMENT CONTAINING SPECIFIC MAGENTA COUPLER AND ANTI-FADING AGENT

FIELD OF THE INVENTION

The present invention relates to a silver halide photographic recording material containing a pyrazolobenzimidazole magenta coupler and an aniline-type anti-fading agent.

BACKGROUND OF THE INVENTION

Silver halide color photography depends on the formation of dyes in order to reproduce an image. These dyes are typically formed from couplers present in or adjacent to the light sensitive silver halide emulsion layers which react to image light upon exposure. During development, the latent image recorded by the silver halide emulsion is developed to amplify the image. During this process in which silver halide is reduced to elemental silver, the color developer compound used is at the same time oxidized, as is typical in a redox reaction. The oxidized developer then reacts or couples with the coupler compound present in or adjacent to the emulsion layer to form a dye of the desired color.

Typically, a silver halide emulsion layer containing a magenta dye-forming coupler is sensitized to green light. This facilitates so-called negative-positive processing in which the image is initially captured in a negative format where black is captured as white, white as black, and the colors as their complimentary colors (e.g., green as magenta, blue as yellow, and red as cyan). Then the original scene can be reproduced in the correct colors through the device of optical printing which has the effect of producing a negative of the negative, or a positive image of the original scene.

Viewable images may also be produced through reversal processing in which the initial negative image is reversed by using a black and white developer, processed to remove the developed silver but leave the undeveloped silver halide, and by then fogging the element in the presence of color developer to provide developed silver in inverse proportion to the amount of image light with corresponding dye formation.

For incorporation into a photographic element, the couplers are typically dissolved in high-boiling organic solvents known as "coupler solvents," and dispersed in gelatin with the aid of surfactants.

One of the difficulties with color couplers is achieving simultaneously all of the required physical and chemical properties of the coupler and the dye formed from it. For instance, the coupler must have good solubility in the coupler solvent, good dispersibility in gelatin, and high dye-forming activity. It must also have a high degree of resistance to decomposition due to light, heat and humidity, which can cause stains. In addition, the resulting image dye must have the proper hue and must have a high degree of resistance to fading or hue changes due to light, heat and humidity.

Couplers that form magenta dyes upon reaction with oxidized color developing agent are described in such representative patents and publications as: "Farbkuppler-eine Literature Ubersicht," published in Agfa Mitteilungen, Band In, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192–350; German OLS 3,624,103; German OLS 3,912,265; and German OLS 40 08 067. Typically, such couplers are pyrazolones and pyrazoloazoles, including pyrazolo[2,3-b][1,2,4]triazoles) described by Formula (A) and pyrazolo[3,2-c][1,2,4]triazoles described by Formula (B).

(A)

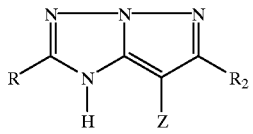

(B)

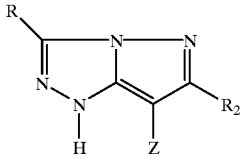

In Formulas (A) and (B), R and $R_2$ represent substituents and Z is a hydrogen atom or a group capable of being split off during the coupling reaction. Typically, $R_2$ is an alkyl group. An alkoxy group in this position leads to image dyes with very poor light stability.

The present invention is concerned with the pyrazolo[1,5-a]benzimidazole type of magenta dye-forming couplers (hereinafter referred to as PBI couplers). These couplers may broadly be described by Formula (1)

(1)

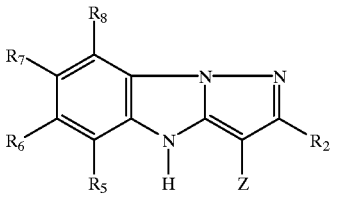

in which $R_2$ and $R_5$-$R_8$ represent substituents and Z represents a hydrogen atom or a group capable of being split off during the coupling reaction. German patent 1,070,030 discloses PBI couplers which form magenta dyes upon coupling. In the examples given, $R_2$ represents an alkyl or phenyl group. Couplers of these types have been found to have poor coupling reactivity and to yield image dyes whose absorption spectra are too bathochromic for practical use in color photographic papers, and to have poor stability to light. International Patent Application WO 91/14970 describes PBI couplers with specifically substituted alkylthio coupling-off groups, including carboxyalkylthio groups. Such couplers offer marked improvements in coupling reactivity but do not offer improved dye hue or light stability. U.S. Pat. No. 5,143,821 describes PBI couplers in which $R_2$ represents an alkoxy group. Such couplers are advantageous because they have much better coupling reactivity than those in which $R_2$ represents an alkyl group, and the image dyes formed from them have good spectral absorption characteristics. However, the light stability of the dyes from the alkoxy PBI couplers is still not sufficient to meet the stringent requirements of future photographic products, especially color photographic papers.

Many classes of compounds are known to improve the light stability of image dyes when incorporated in the photographic element in combination with the coupler. Examples of such "light stabilizers" or "discoloration inhibitors," as they are commonly known, are 6-hydroxychromans as described, for example in U.S. Pat. No. 3,467,772; spiroindanes as described, for example in U.S. Pat. No. 4,360,589; methylenebisphenols as described, for example in British patent 1,529,908, U.S. Pat. Nos. 3,770,455, and 5,063,148; and so forth. However, none of these types of stabilizers have been found to provide sufficient improvement in the light stability of image dyes from PBI couplers to meet the stringent requirements of future photographic products, especially color photographic papers.

Light stabilizers of the type represented by Formula (2), wherein $Z_1$ and $Z_2$ are alkylene groups of 1–3 carbon atoms, R is an aryl or heterocyclic group, and q is 1 or 2, are disclosed in U.S. Pat. No. 4,880,733.

(2)

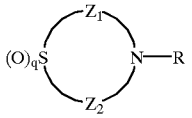

One of the embodiments of the stabilizer of Formula (2) is the thiomorpholinedioxide represented by Formula (2a), (2a)

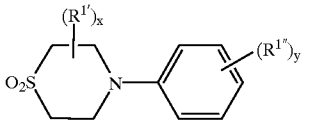

wherein $R^{1'}$ is alkyl; $R^{1''}$ is alkyl, alkoxy, alkylthio, amido, ureido or halogen; x is 0 to 4; andy is 1 or 2.

The stabilizers of Formula (2) and (2a) are disclosed for use in combination with pyrazoloazole (PA) magenta couplers but there is no suggestion that the stabilizers would be useful with PBI couplers having particular substituent groups. In view of the relatively poor performance of the other stabilizer classes described above with PBI couplers, there is no basis upon which to predict that this type of heterocyclic stabilizer would be effective with PBI couplers. Furthermore, the very different effects of $R_2$ on the light stabilities of the image dyes from PA couplers described by Formulas (A) and (B) as compared to the effect on PBI couplers described by Formula (1) clearly shows the non-equivalence of these classes of couplers with respect to that property.

A problem to be solved is to provide a magenta dye forming system that has good dye-forming ability and that exhibits good dye stability.

SUMMARY OF THE INVENTION

The invention provides a photographic element comprising a support on which is coated at least one green-sensitized silver halide emulsion layer having associated therewith at least one magenta dye-forming coupler of Formula (1a) and at least one compound of Formula (2)

(1a)

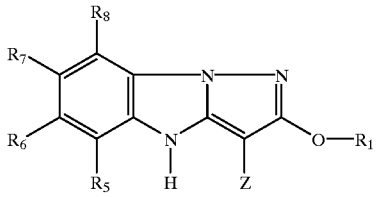

wherein:

$R_1$ is an alkyl group;

$R_5$, $R_6$, $R_7$, and $R_8$ each independently represent a hydrogen atom or a substituent;

Z is a hydrogen atom or a group that can be split off by the reaction of the coupler with an oxidized color-developing agent;

(2)

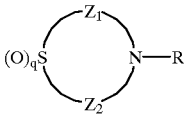

wherein:

$Z_1$ and $Z_2$ are alkylene groups of 1–3 carbon atoms;

R is an aryl or heterocyclic group, and q is 1 or 2.

The element of the invention provides a magenta dye forming system that has good dye-formning ability and that exhibits good dye stability.

DETAILED DESCRIPTION OF THE INVENTION

The coupler of the invention is more particularly described by Formula (1a).

(1a)

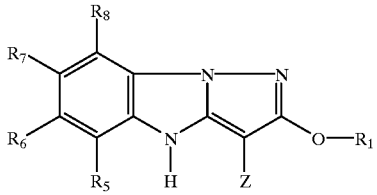

In Formula (1a), $R_1$ is an alkyl group which may be linear, branched, or cyclic and saturated or unsaturated. Groups are defined hereinafter to include substituted or unsubstituted forms of substitutable groups. Preferably, $R_1$ represents an alkyl group in which the first carbon atom has no more than one hydrogen atom attached; that is, a secondary, tertiary or cyclic alkyl group. Any substituent may be used on $R_1$ provided it is not incompatible with the intended use of the coupler. Examples of such groups include, but are not limited to, an alkyl group, an aryl group, a halogen atom (e.g., Cl, Br or F), a nitro group, a cyano group, a hydroxyl group, an alkoxy group, a sulfonyl group, a sulfamoyl group, a carbamoyl group, a carbonamido group, a sulfonamido group, a carboxy group, a carboalkoxy or carboaryloxy group, an amino group, an alkylthio group, and an arylthio group. Most preferably, $R_1$ represents a secondary, tertiary, or cyclic alkyl group.

In Formula (1a), $R_5$, $R_6$, $R_7$, and $R_8$ each independently represents a hydrogen atom or a substituent. Preferably, $R_5$, $R_6$, $R_7$, and $R_8$ are each a hydrogen atom.

In Formula (1a), Z is a hydrogen atom or a group that can be split off by the reaction of the coupler with an oxidized color developing agent, known in the art as a "coupling-off" group. Typical coupling-off groups are halogen atoms and aliphatic, aromatic or heterocyclic groups attached to the coupling site by means of an oxygen, sulfur or nitrogen atom. Suitably, Z is an alkylthio group which may be substituted as described in International Patent Application WO 91/14970. Most suitably, Z is an carboxyalkylthio or thioglycerol group.

The following examples further illustrate the coupler of the invention.

M-1

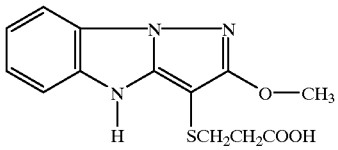

M-2

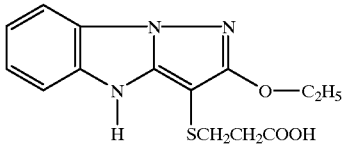

M-3

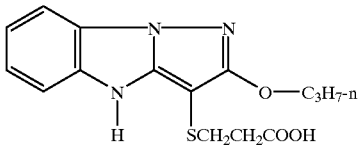

M-4

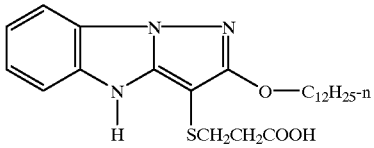

M-5

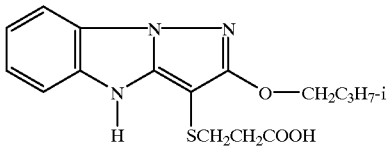

M-6

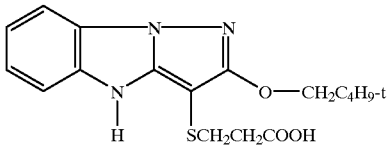

M-7

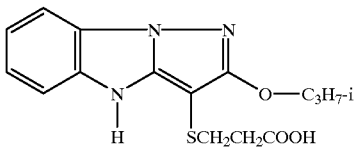

-continued
M-8
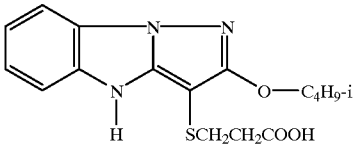
M-9
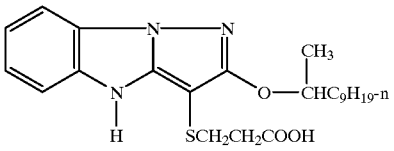
M-10
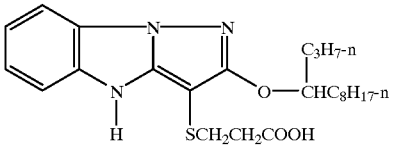
M-11
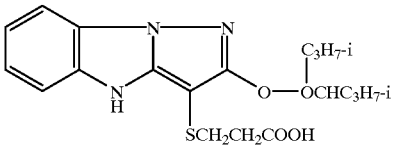
M-12
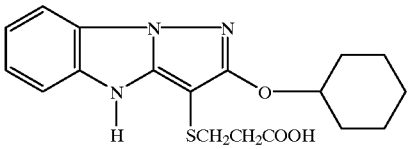
M-13
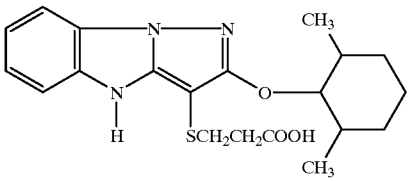
M-14
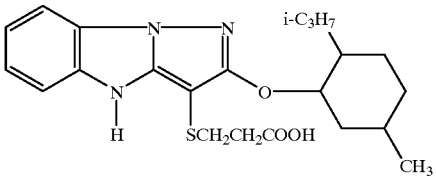
M-15
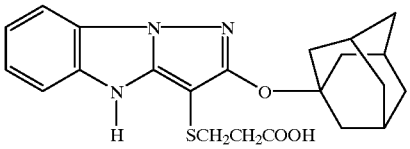
M-16
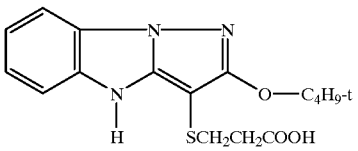

-continued
M-17
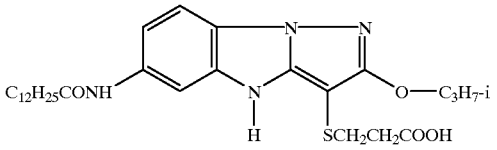
M-18
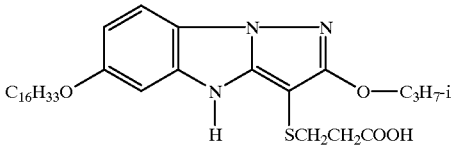
M-19
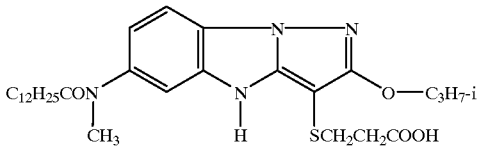
M-20
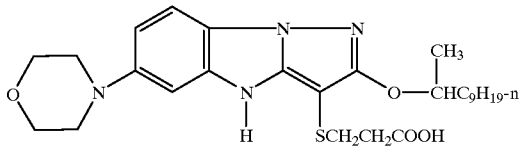
M-21
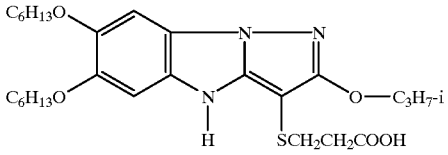
M-22
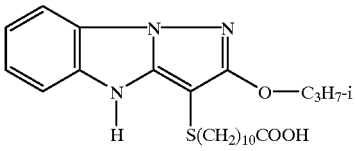
M-23
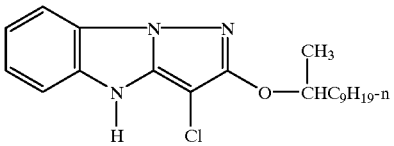
M-24
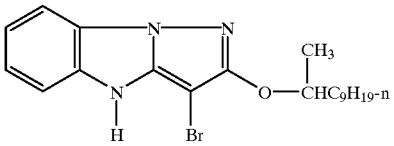
M-25
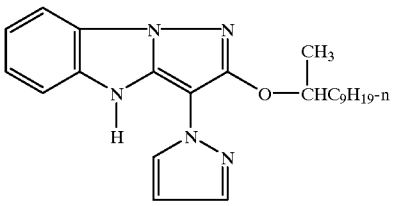

-continued
M-26
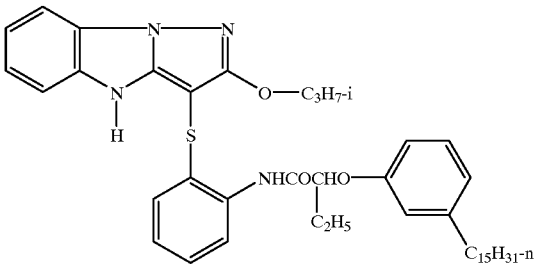
M-27
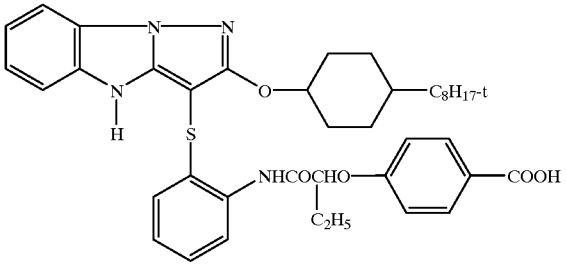
M-28
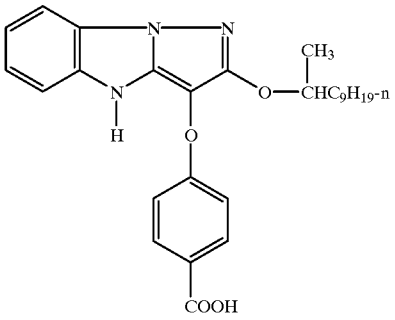
M-29
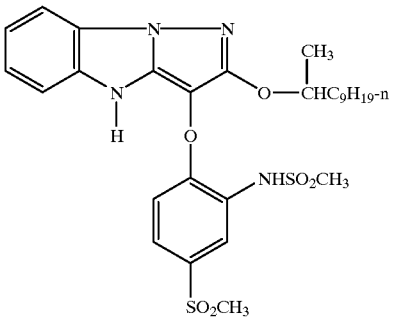
M-30
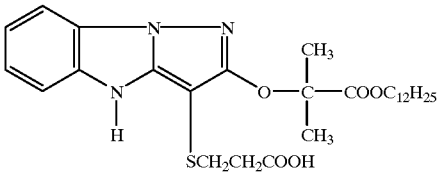
M-31
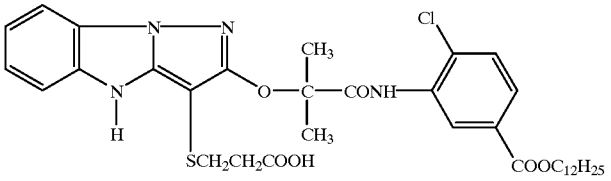

-continued
M-32
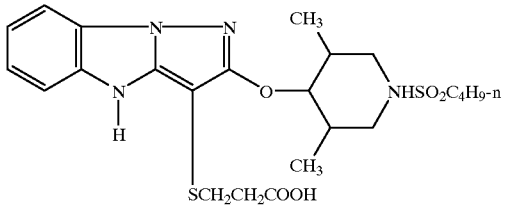
M-33
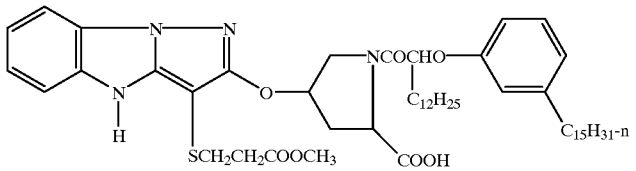
M-34
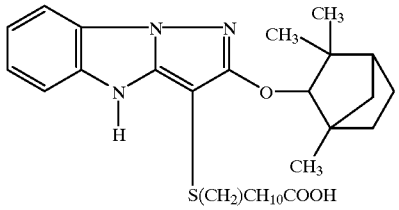
M-35
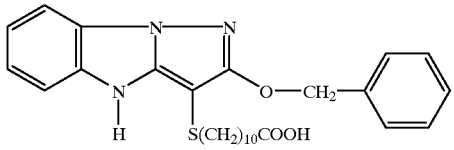
M-36
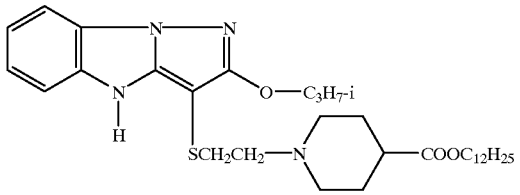
M-37
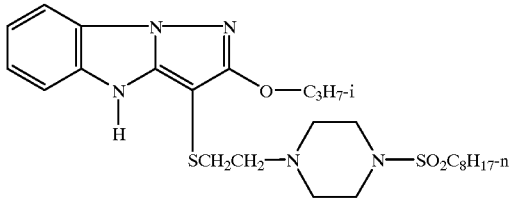
M-38
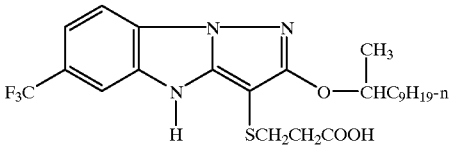
M-39
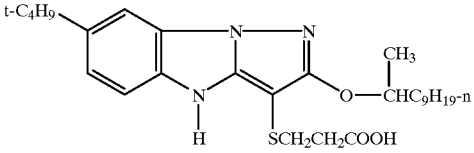

-continued
M-40
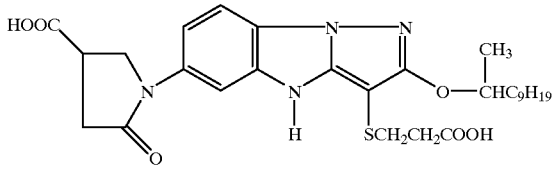
M-41
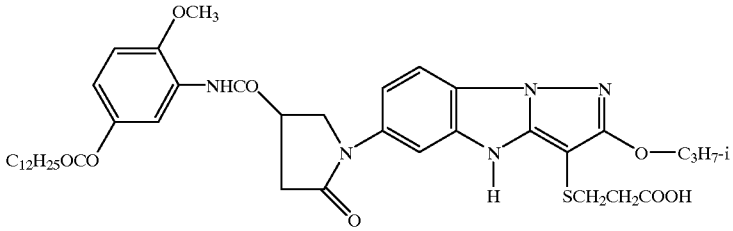
M-42
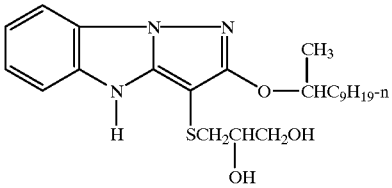
M-43
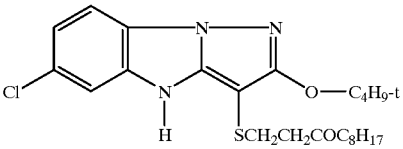
M-44
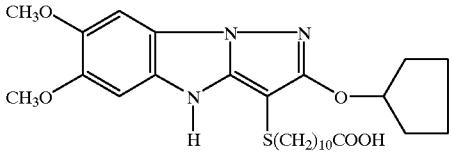
M-45
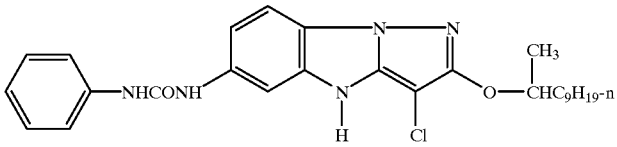
M-46
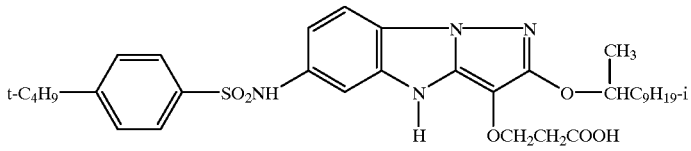
M-47
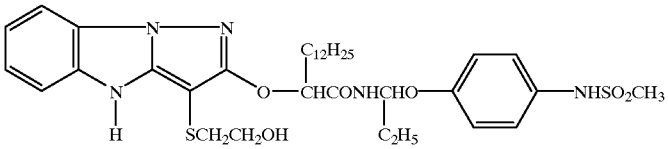

-continued

M-48

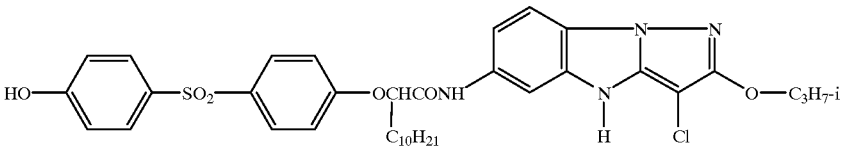

M-49

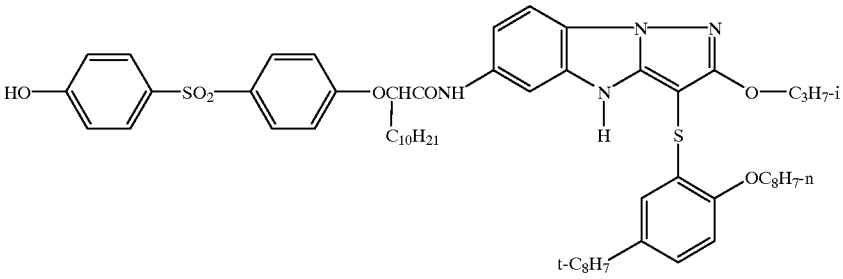

M-50

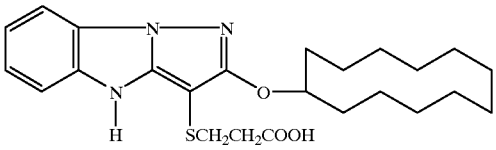

M-51

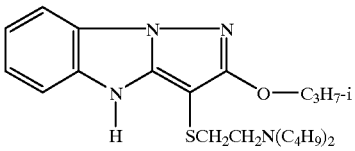

The stabilizer of the invention may be represented by formula (2):

(2)

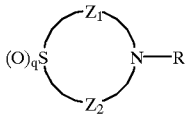

wherein $Z_1$ and $Z_2$ are alkylene groups of 1–3 carbon atoms;

R is an aryl or heterocyclic group, and q is 1 or 2.

In a particular embodiment of the invention, the stabilizer is more specifically represented by Formula (3a).

(3a)

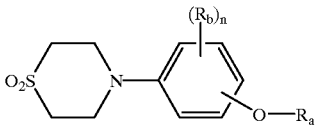

In Formula (3a)

$R_a$ is an alkyl group;

$R_b$ is an alkyl group, an alkoxy group, a primary or secondary amino group, or an amido group;

n is an integer from 0 to 4.

The following examples further illustrate the stabilizer of the invention.

ST-1

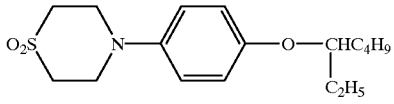

ST-2

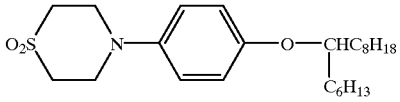

ST-3

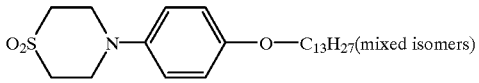

ST-4

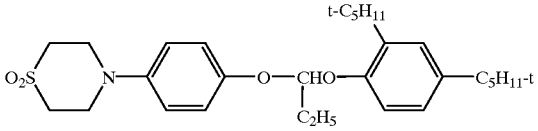

ST-5

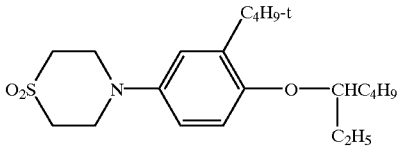

-continued

ST-6

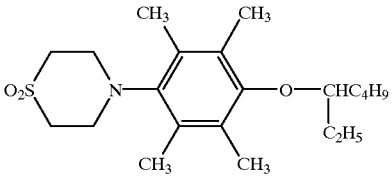

ST-7

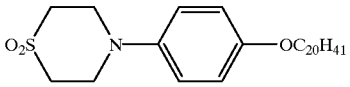

ST-8

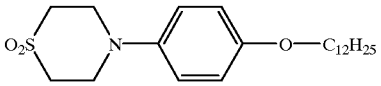

ST-9

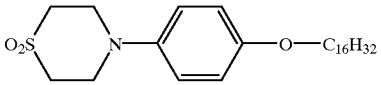

ST-10

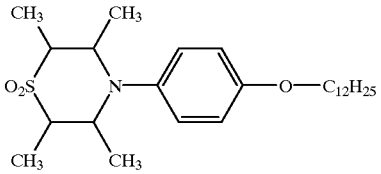

ST-11

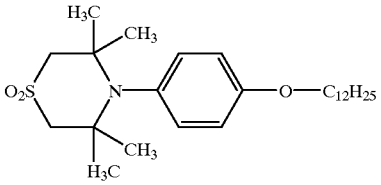

ST-12

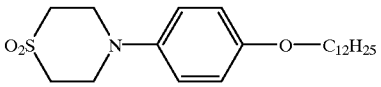

ST-13

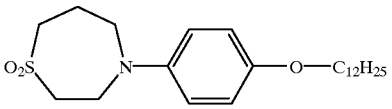

ST-14

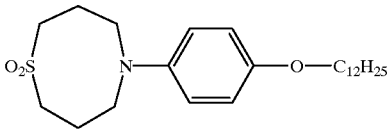

ST-15

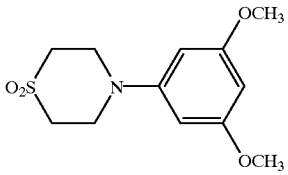

-continued

ST-16

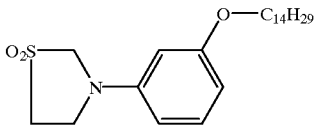

These stabilizers may be prepared as described in U.S. Pat. No. 4,880,733.

It is often desirable to include one or more additional stabilizers. One type is represented by formula (4):

(4)

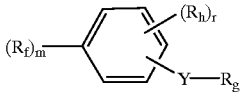

wherein:

each $R_f$ is an independently selected alkyl or alkoxy group having 1–32 carbon atoms and m is 1–4;

each $R_h$ is an independently selected substituent and r is 0–4;

Y is —$NHSO_2$— or —$SO_2NH$—; and $R_g$ is an alkyl group of 1–16 carbon atoms.

Examples are:

4-1

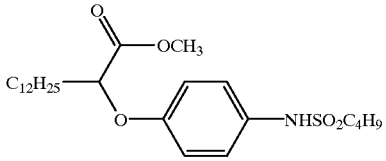

4-2

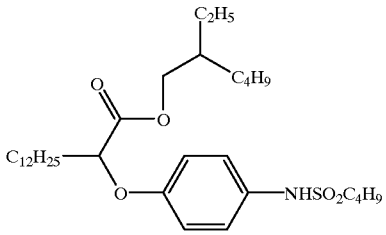

4-3

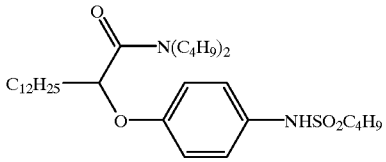

4-4

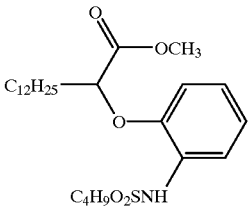

-continued 4-5

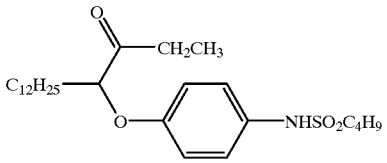

4-6

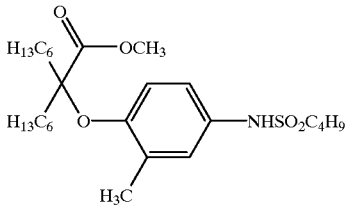

4-7

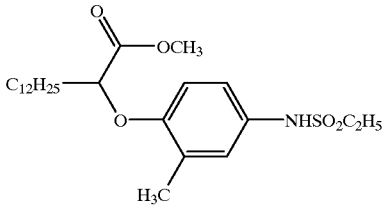

4-8

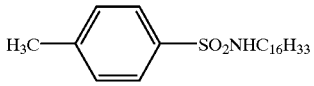

4-9

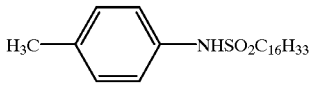

Another secondary stabilizer that may be employed is represented by Formula (5):

(5)

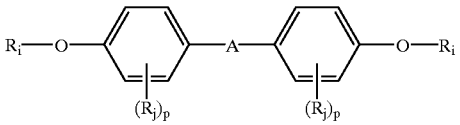

wherein:

each $R_i$ independently represents a hydrogen atom, an alkyl group, an alkenyl group or an aryl group;

each $R_j$ independently represents a halogen atom, an alkyl group, an alkenyl group an alkoxy group, an aryl group, an aryloxy group, an alkylthio group, an aryl thio group, an acyl group, an acylamino group, a sulfonyl group, a sulfonamide group or a hydroxy group;

each p is, individually an integer of 0 to 4; and

A represents an alkylene group having 1 to 6 carbon atoms in its linear structure.

The stabilizers that have the Formula (5), above, are believed to stabilize the dye image by scavenging free radicals. In this formula, the group represented by A is a straight, branched, or cyclic alkylene group, the linear portion of which has 1 to 6 carbon atoms, which includes those such groups substituted with one or more aryl, cyano, halogen, heterocyclyl, cycloalkyl, alkoxy, hydroxy, and aryloxy groups. The alkylene group can form a cycloalkyl ring, such as

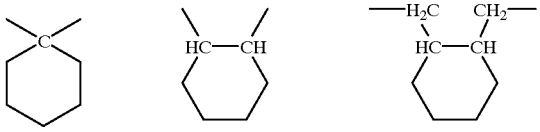

In Formula (5), each $R_i$ can be a substituent group such as halogen, alkyl, cycloalkyl, alkenyl, alkoxy, aryl, aryloxy, alkylthio, arylthio, acyl, acylamino, sulfonyl and sulfonamido groups.

Preferred compounds represented by Formula (5), are those in which:

each $R_i$ is independently hydrogen or a (cyclo)alkyl group of 1 to 8 carbon atoms;

each $R_j$ is independently hydrogen, hydroxy, alkyl or alkoxy group of 1 to 8 carbon atoms;

each p is independently an integer of 0 to 2; and

A is an alkylene group of 1 to 10 carbon atoms.

Representative examples of stabilizer compounds which satisfy Formula (5) are:

5-1

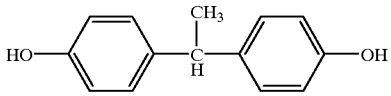

5-2

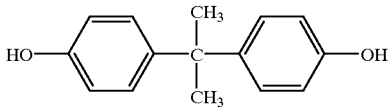

5-3

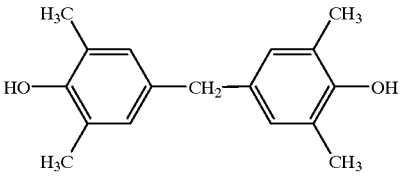

5-4

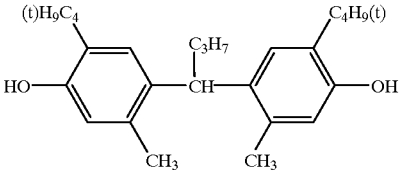

5-5

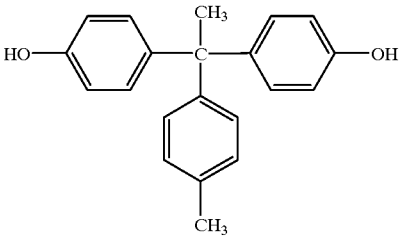

5-6

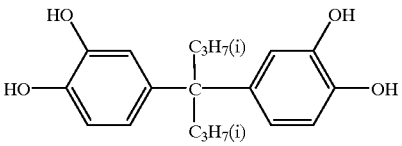

The elements of the invention also provide other advantageous photographic properties such as sensitivity, activity, Dmin, coupler and dye stability, manufacturability, low process sensitivity, dye hue etc.

Unless otherwise specifically stated, the term substituted or substituent means any group or atom other than hydrogen bonded to the remainder of a molecule. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamiido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy- 3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94–6023, published Mar. 15, 1994, available from the Japanese Patent Office, the contents of which are incorporated herein by reference. When it is desired to employ the inventive materials in a small format film, *Research Disclosure*, Jun. 1994, Item 36230, provides suitable embodiments.

In the following discussion of suitable materials for use in the emulsions and elements of this invention, reference will be made to Research Disclosure, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0545300; EPO 0556700; EPO 0556777; EPO 0556858; EP 0 569979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band im, pp. 126–156 (1961) as well as U.S. Pat. No. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841; EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192–350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632, 345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Patent Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58–172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859, 578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543, 323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

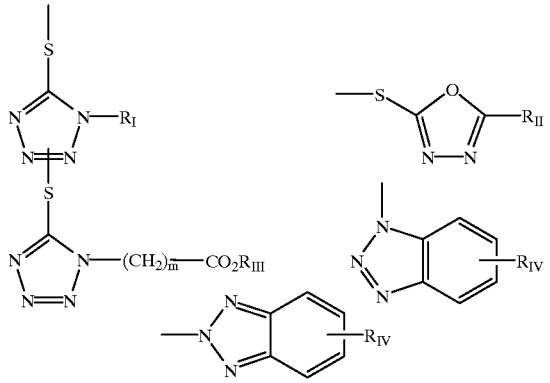

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the eveloper inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. No. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

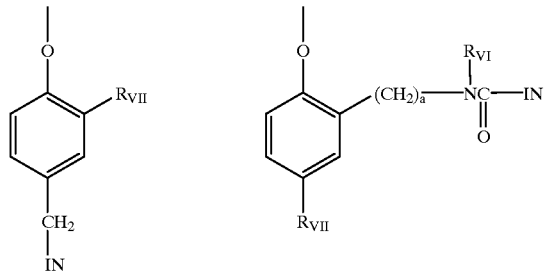

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

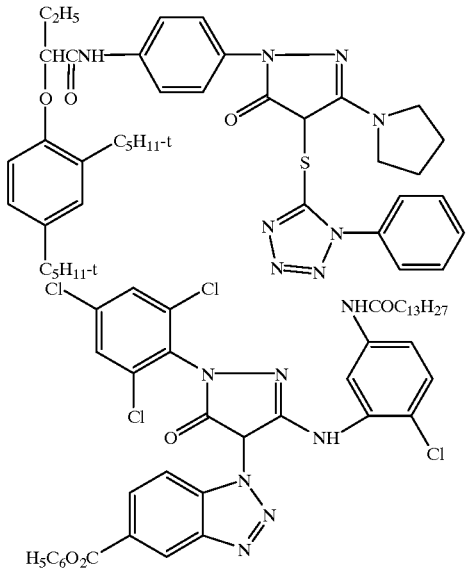

D2

D3

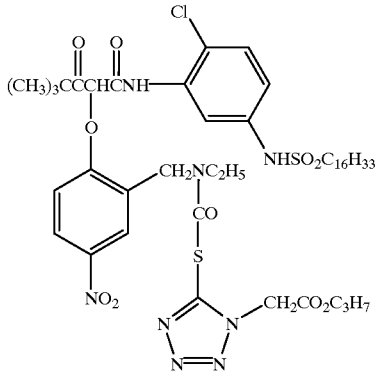

D4

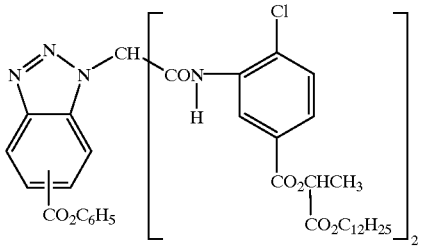

-continued
D5
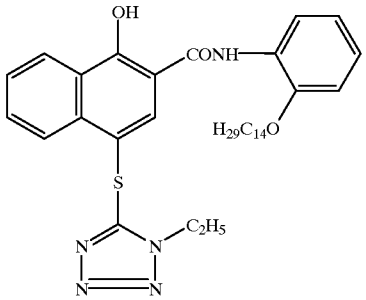
D6
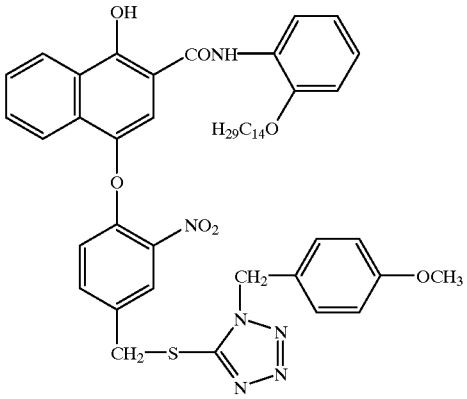
D7
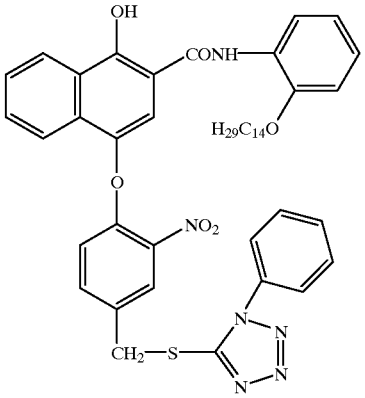
D8
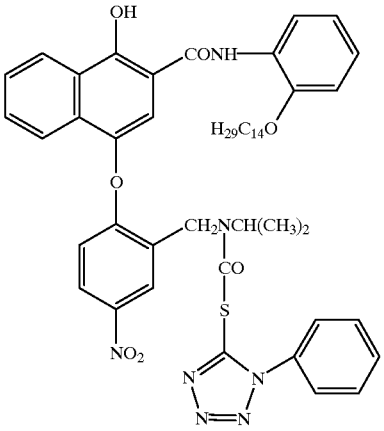
-continued
D9
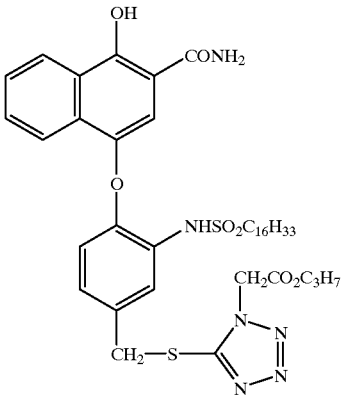
D10
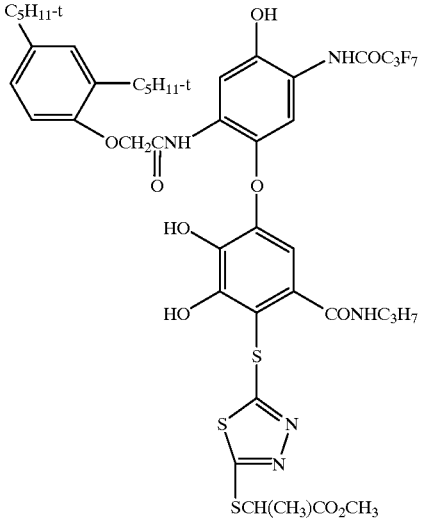
D11
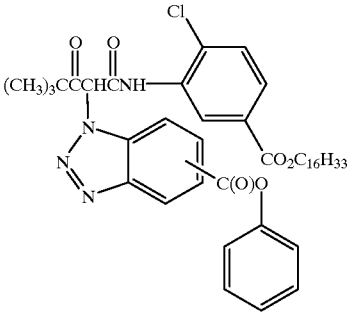
D12
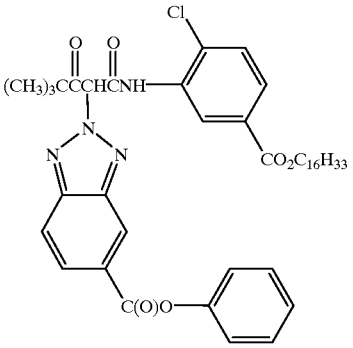

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072, 633; 90-072,634; 90-077,822; 90-078,229; 90-078,230; 90-079,336; 90-079,337; 90-079,338; 90-079,690; 90-079, 691; 90-080,487; 90-080,488; 90-080,489; 90-080,490; 90-080,491; 90-080,492; 90-080,494; 90-085,928; 90-086, 669; 90-086,670; 90-087,360; 90-087,361; 90-087,362; 90-087,363; 90-087,364; 90-088,097; 90-093,662; 90-093, 663; 90-093,664; 90-093,665; 90-093,666; 90-093,668; 90-094,055; 90-094,056; 90-103,409; 83-62,586; 83-09, 959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of of total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061, 609, Tsaur et al U.S. Pat. Nos. 5,147,771, '772, '773, 5,171,659 and 5,252,453, Black et al 5,219,720 and 5,334, 495, Delton U.S. Pat. No. 5,310,644, 5,372,927 and 5,460, 934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are llustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 667,955.

High bromide {100} tabular grain emulsions are illustrated by ignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713, 323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271, 858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320, 938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

- 4-amino-N,N-diethylaniline hydrochloride,
- 4-amino-3-methyl-N,N-diethylaniline hydrochloride,
- 4-amino-3-methyl-N-ethyl-N-(2-methanesulfonamidoethyl)aniline sesquisulfate hydrate,
- 4-amino-3-methyl-N-ethyl-N-(2-hydroxyethyl)aniline sulfate,
- 4-amino-3-(2-methanesulfonamidoethyl)-N,N-diethylaniline hydrochloride, and
- 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications referred to in this specification are incorporated herein by reference.

Preparation of Coupler M-7

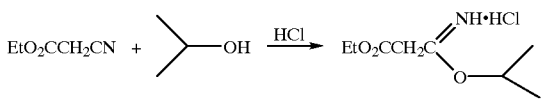

Ethyl cyanoacetate (11.3 g)(0.1 m) and isopropanol (6.0 g)(0.1 m) were dissolved in anhydrous ether (ca 16 ml). HCl gas was passed through the solution at 0–10 degrees for 1.5 hours, until saturated. The flask was stoppered and stood in the refrigerator over the weekend. The solvent was then removed under vacuum at room temperature leaving an oil. Toluene (ca 50–100 ml) was added and decanted from the oil. Ligroin (ca 100 ml) was added and stripped off on the rotary evaporator at RT or below, giving a white solid. The solid was worked up with more ligroin, filtered and dried. The yield was 18 g (85.9%).

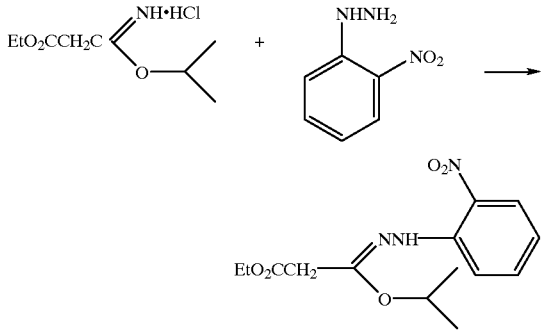

2-Nitrophenylhydrazine (1.53 g)(0.01 m) was dissolved in t-butanol (25 m). The imidate shown (2.1 g)(0.01 m) was added to the mixture. Solution was stirred for about an hour, until starting material has disappeared. Product is a mixture by TLC. Ethyl acetate (200 ml) was added, and the solution washed with water containing a little NaCl, 2 times to remove ammonium chloride. The ethyl acetate layer was dried over magnesium sulfate and evaporated to dryness, giving a red oil.

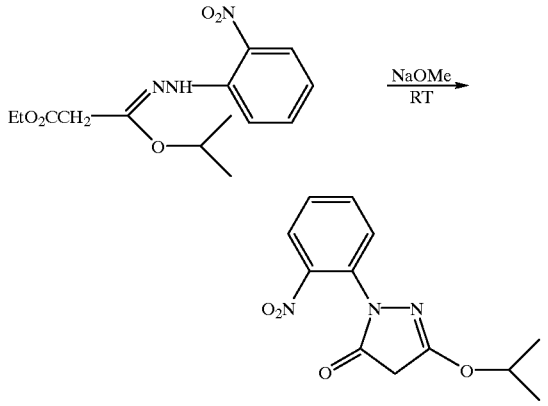

Sodium (0.46 g)(0.02 m) was dissolved in 25 ml anhydrous methanol. The sodium methoxide solution was added to the red oil from above. (The reaction mixture was checked by TLV by spotting into water and acidifying with dilute acetic acid prior to extraction into EtAc). The reaction should form a single spot essentially. May need to leave overnight. The reaction was added dropwise into 150 ml of 10% acetic acid in water into which was dissolved a little NaCI. The product was filtered and washed with water. The yield was 1.77 g. The solid was recrystallized from hot heptane (200–250 ml). (decanted from black oily residue). The yield was 1.4 g (53%).

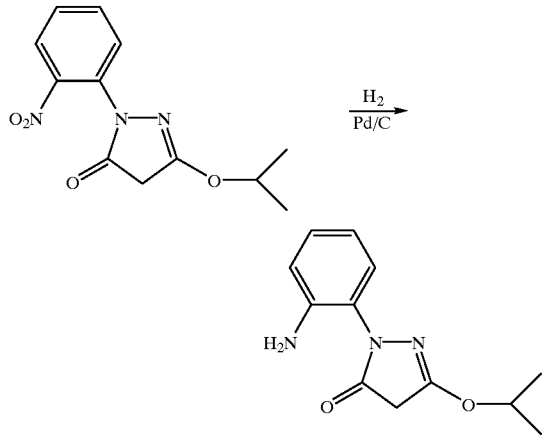

Reduction was carried out in THE with Pd/C at RT and 200–300 psi hydrogen. The yield after evaporation of solvent was 5.67 g (99.1%).

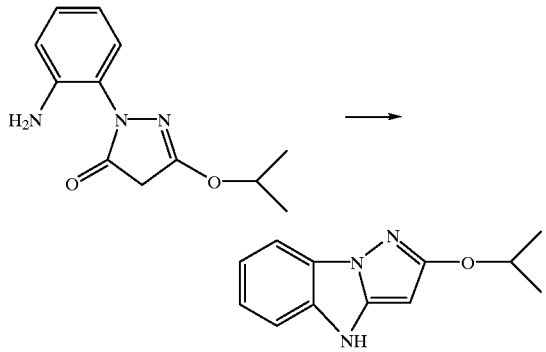

The amine, isolated from reduction, (14 g)(0.06 m) was dissolved in DMF(210 ml), and p-toluene sulfonic acid (1.4 g) was added. The mixture was heated on a steam bath for 5 hours, then left overnight at room temperature. It was heated for a further 4 hours until TLC indicated starting material had disappeared. The solution was added dropwise to water (2000 ml). An orange solid precipitated. It was filtered, washed with water and dried. The yield was 11.03 g. The solid was recrystallized from toluene (200 ml) giving 8.13 g. A second crop yielded a further 1.08 g. Total yield was 71.3%.

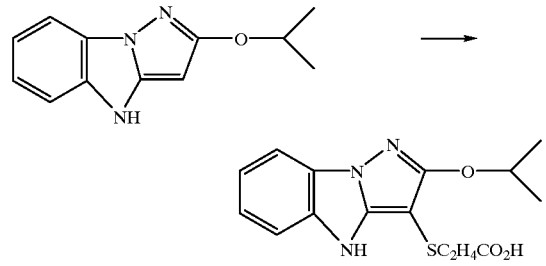

2-Isopropoxypyrazolo[5,1-a]benzimidazole (6.45 g)(0.03 m) and mercaptopropionic acid (4.14 g)(0.39 m) were dissolved in DMF (156 ml). Bromine (7.02 g)(0.039 m) was added in 15 mls of DMF, dropwise at RT. The mixture was stirred at RT until complete (overnight) and then added dropwise to water (1200 mls) with stirring. Initially it was sticky but slowly went solid. The product was filtered to give a brownish solid. Crude yield was 7.5 g (78.3%). Product was crystallized from toluene (75 mls), giving 6.7 grams (70%).

Preparation of Photographic Elements

Coupler M-2 and coupler solvents dibutyl phthalate and didecyl phthalate were dispersed in aqueous gelatin in the following manner: Coupler M-2 (0.228 g, 0.75 mmol) was dissolved in a mixture of dibutyl phthalate (0.384 g), didecyl phthalate (0.384 g) and ethyl acetate (1.152 g). The mixture was heated to effect solution. After adding aqueous gelatin (22.21 g, 11.5% soln.) and diisopropylnaphthalene sulfonic acid (sodium salt) (2.55 g 10% solution), the mixture was dispersed passing it three times through a Gaulin homogenizer. This dispersion was used in the preparation of the photographic element 101.

Dispersions containing the couplers and stabilizers shown for elements 102–105 in Table 1 were prepared in a similar manner. The amount of each coupler was 0.75 mmol, the amount of each stabilizer except CST-1 was 0.75 mmol, and the amount of each solvent was equal to half the combined weights of the coupler and stabilizers. The amount of CST-1 in element 102 was 0.375 mmol, because each molecule of CST-1 contains two active stabilizing moieties that are joined by a common carbon atom.

Photographic Elements 101–105 were Prepared as Follows

On a gel-subbed, polyethylene-coated paper support were coated the following layers:

First Layer

An underlayer containing 3.23 grams gelatin per square meter.

Second Layer

A photosensitive layer containing (per square meter) 2.15 grams total gelatin, an amount of green-sensitized silver chloride emulsion containing 0.172 grams silver; the dispersion containing $4.7\times10^{-4}$ mole of the coupler indicated in Table 1; and 0.043 gram surfactant Alkanol XC (trademark of E. I. Dupont Co.)(in addition to the Alkanol XC used to prepare the coupler dispersion.

Third Layer

A protective layer containing (per square meter) 1.40 g gelatin, 0.15 g bis (vinsulfonyl)methyl ether, 0.043 g Alkanol XC, and $4.40\times10^{-6}$ g tetraethylammonium perfluorooctanesulfonate.

TABLE 1

| Element | Comparison or Invention | Coupler | Stabilizer(s) |
|---|---|---|---|
| 101 | Comparison | M-2 | none |
| 102 | Comparison | M-2 | CST-1 |
| 103 | Comparison | M-2 | CST-3 |
| 104 | Invention | M-2 | ST-1 |
| 105 | Invention | M-2 | ST-1<br>CST-4 |

Coupler M-7 and coupler solvents dibutyl phthalate and bis(2-ethylhexyl)phthalate were dispersed in aqueous gelatin in the following manner:

Coupler M-7 (0.312 g, 0.98 mmol) was dissolved in a mixture of (0.429 g), bis(2-ethylhexyl) phthalate (0.429 g) and ethyl acetate (0.937 g). The mixture was heated to effect solution. After adding aqueous gelatin (21.93 g, 11.5%) and diisopropylnaphthalene sulfonic acid (sodium salt) (2.51 g 10% solution), the mixture was dispersed passing it three times through a Gaulin homogenizer. This dispersion was used in the preparation of the photographic element 201.

Dispersions containing the couplers and stabilizers shown for elements 202–213 in Table 2 were prepared in a similar manner. The amount of coupler was 0.98 mmol, the amount of each stabilizer was as listed (in mmol), and the amount of each solvent was the same as in element 201. Note that because CST-1 comprises two active stabilizing moieties, element 202 contains twice as ilizer as elements 203–213.

Photographic elements 201–213 were prepared like those of elements 101–105, except that the amount of coupler in the second layer of each element was $6.1\times10^{-4}$ mole.

TABLE 2

| Element | Comparison or Invention | Coupler | Stabilizer-(mmol) |
|---|---|---|---|
| 201 | Comparison | M-7 | none |
| 202 | Comparison | M-7 | CST-1 (.84) |
| 203 | Comparison | M-7 | CST-2 (.84) |
| 204 | Comparison | M-7 | CST-3 (.84) |
| 205 | Comparison | M-7 | CST-4 (.84) |
| 206 | Invention | M-7 | ST-1 (.84) |
| 207 | Invention | M-7 | ST-2 (.84) |
| 208 | Invention | M-7 | ST-3 (.84) |
| 209 | Invention | M-7 | ST-1 (.84)<br>CST-1 (.75) |
| 210 | Invention | M-7 | ST-1 (.84)<br>CST-2 (.75) |
| 211 | Invention | M-7 | ST-1 (.84)<br>CST-3 (.75) |
| 212 | Invention | M-7 | ST-1 (.84)<br>CST-4 (.75) |
| 213 | Invention | M-7 | ST-1 (.84)<br>CST-4 (.75)<br>CST-5 (.98) |

The dispersions and photographic elements 214–229 were like those of element 212, except that the couplers shown in Table 3 were used.

TABLE 3

| Element | Comparison or Invention | Coupler |
|---|---|---|
| 214 | Invention | M-1 |
| 215 | Invention | M-3 |
| 216 | Invention | M-4 |
| 217 | Invention | M-5 |
| 218 | Invention | M-6 |
| 219 | Invention | M-8 |
| 220 | Invention | M-9 |
| 221 | Invention | M-10 |
| 222 | Invention | M-11 |
| 223 | Invention | M-12 |
| 224 | Invention | M-13 |
| 225 | Comparison | CM-1 |
| 226 | Comparison | CM-2 |
| 227 | Comparison | CM-3 |
| 228 | Comparison | CM-4 |
| 229 | Comparison | CM-5 |

The dispersions and photographic elements 230 and 231 were like those of element 212, except that the couplers shown in Table 4 were used, and the amounts of dibutyl phthalate and bis(2-ethylhexyl) phthalate used were 1.287 g each, three times the amounts used in element 212.

TABLE 4

| Element | Comparison or Invention | Coupler |
|---|---|---|
| 230 | Invention | M-7 |
| 231 | Invention | M-12 |

CM-1

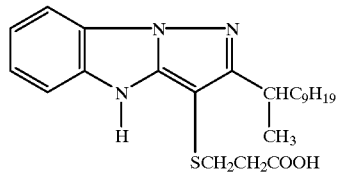

CM-2

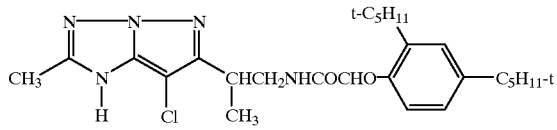

CM-3

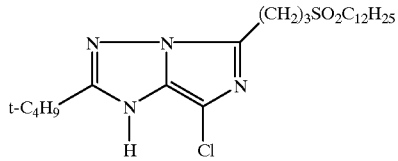

CM-4

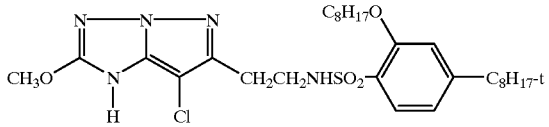

CM-5

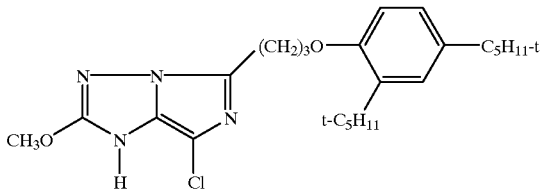

CST-1

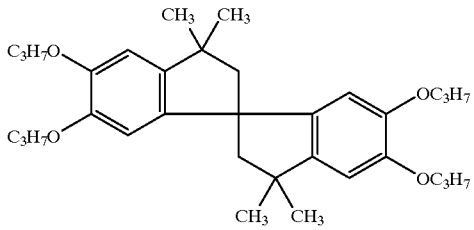

CST-2

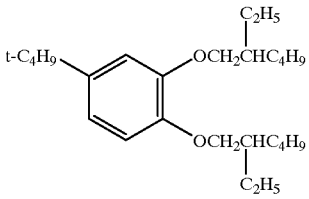

-continued

CST-3

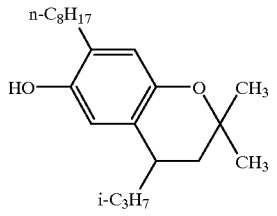

CST-4

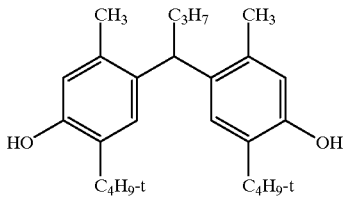

CST-5

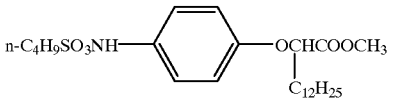

Note that comparison coupler CM-1 is a pyrazolobenzimidazole coupler similar to those of the invention except that the alkoxy group —$OR_1$ of Formula (1a) is replaced by a simple alkyl group. Comparison couplers CM-2 and CM-3 are pyrazolotriazole couplers used commercially in color photographic papers. Comparison couplers CM-4 and CM-5 are pyrazolotriazole couplers that are substituted by an alkoxy group in the position on the pyrazole ring that corresponds to the position of —$OR_1$ in the couplers of the invention.

Comparison stabilizers CST-1, CST-3, and CST-4 are used in the magenta layers of commercially available color photographic papers.

Preparation of Processed Photographic Elements

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

Developer

| | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |

-continued

| | |
|---|---|
| Potassium bromide | 7.00 mg |

pH adjusted to 10.4 at 26.7° C.

Bleach-Fix

| | |
|---|---|
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetra acetate | 48.58 g |
| Ethylenediaminetetraacetic acid | 3.86 g |

pH adjusted to 6.7 at 26.7° C.

Dev-1

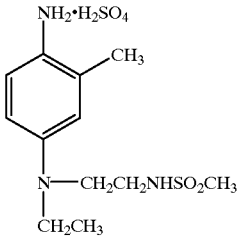

The density of each step of each strip was measured. Each strip was then covered by a UV-absorbing filter (in lieu of coating a similar filter layer over the photosensitive layer of the photographic element) and subjected to irradiation by the light of a xenon arc lamp at an intensity of 50,000 lux for 3 weeks. The light stability of the dye ("Dye Stab"), expressed as the percent of the initial density to green light remaining from initial densities of 1.0 and 1.7, is shown in Tables 5–10.

The effects of varying the stabilizers used in the photographic elements are illustrated by the examples in Tables 5, 6 and 7. The data in Table 5 illustrate the effects of the stabilizers of the invention and other stabilizers on the light stability of the image dye obtained from coupler M-2 of the invention.

TABLE 5

| | | | | | Dye Stability | |
|---|---|---|---|---|---|---|
| Example | Element | Comp/Inv | Coup | Stab(s) | from 1.0 | from 1.7 |
| 1 | 101 | Comp. | M-2 | none | 11 | 8 |
| 2 | 102 | Comp. | M-2 | CST-1 | 38 | 24 |
| 3 | 103 | Comp. | M-2 | CST-3 | 21 | 25 |
| 4 | 104 | Inv. | M-2 | ST-1 | 71 | 70 |
| 5 | 105 | Inv. | M-2 | ST-1 + CST-4 | 77 | 78 |

Example 4, which contains stabilizer ST-1 of our invention has much better dye stability than any of the comparison examples 1–3, which do not contain stabilizers of the invention. When ST-1 is combined with another stabilizer, as shown in Example 5, the stability is further improved.

The data in Table 6 illustrate the effects of the stabilizers of our invention and other stabilizers on the light stability of the image dye obtained from coupler M-7 of the invention.

TABLE 6

| Example | Element | Comp/Inv | Coup | Stab(s) | Dye Stability from 1.0 | Dye Stability from 1.7 |
|---|---|---|---|---|---|---|
| 6 | 201 | Comp. | M-7 | none | 13 | 9 |
| 7 | 202 | Comp. | M-7 | CST-1 | 78 | 73 |
| 8 | 203 | Comp. | M-7 | CST-2 | 65 | 57 |
| 9 | 204 | Comp. | M-7 | CST-3 | 25 | 25 |
| 10 | 205 | Comp. | M-7 | CST-4 | 27 | 39 |
| 11 | 206 | Inv. | M-7 | ST-1 | 83 | 83 |
| 12 | 207 | Inv. | M-7 | ST-2 | 78 | 77 |
| 13 | 208 | Inv. | M-7 | ST-3 | 83 | 81 |

Examples 11–13 which contain stabilizers ST-1, ST-2, and ST-3 of invention have better light stability than comparison Examples 6–10. Even though the photographic element of Example 7 contains a full molar equivalent of lizer CST-1 containing two active stabilizer moieties, the dye stability of this element is still inferior to those of the invention which contain only one stabilizer moiety.

The data in Table 7 illustrate the effects of combining the stabilizers of our invention with other stabilizers.

TABLE 7

| Example | Element | Comp/ Inv | Coup | Stabi- lizer | Dye Stability from 1.0 | Dye Stability from 1.7 |
|---|---|---|---|---|---|---|
| 14 | 202 | Comp. | M-7 | CST-1 | 78 | 73 |
| 15 | 209 | Inv. | M-7 | ST-1 + CST-1 | 80 | 78 |
| 16 | 203 | Comp. | M-7 | CST-2 | 65 | 57 |
| 17 | 210 | Inv. | M-7 | ST-1 + CST-2 | 76 | 85 |
| 18 | 204 | Comp. | M-7 | CST-3 | 25 | 25 |
| 19 | 211 | Inv. | M-7 | ST-1 + CST-3 | 71 | 76 |
| 20 | 205 | Comp. | M-7 | CST-4 | 27 | 39 |
| 21 | 212 | Inv. | M-7 | ST-1 + CST-4 | 81 | 82 |
| 22 | 213 | Inv | M-7 | ST-1 + CST-4 + CST-5 | 83 | 84 |

Comparing Example 14 with Examples 15 and 16; Examples 17 18 with 19, and Example 20 with 21 and 22 shows that each of the elements containing stabilizer ST-1 of the invention in combination with one or more comparison stabilizers has better dye stability than the corresponding element containing only the comparison stabilizer.

The effects of varying the coupler are illustrated by the examples in Tables 8 and 9. All of the elements in these examples contain stabilizer ST-1 of the invention in combination with stabilizer CST-4.

TABLE 8

| Example | Element | Comp/Inv | Coup | Stab(s) | Dye Stability from 1.0 | Dye Stability from 1.7 |
|---|---|---|---|---|---|---|
| 23 | 105 | Inv. | M-2 | ST-1 + CST-4 | 77 | 78 |
| 24 | 106 | Inv. | M-7 | ST-1 + CST-4 | 82 | 82 |
| 25 | 107 | Comp. | CM-1 | ST-1 + CST-4 | 53 | 61 |
| 26 | 108 | Comp. | CM-3 | ST-1 + CST-4 | 66 | 74 |

TABLE 9

| Example | Element | Comp/Inv | Coup | Stab(s) | Dye Stability from 1.0 | Dye Stability from 1.7 |
|---|---|---|---|---|---|---|
| 27 | 214 | Inv. | M-1 | ST-1 + CST-4 | 75 | 75 |
| 28 | 215 | Inv. | M-3 | ST-1 + CST-4 | 78 | 78 |
| 29 | 216 | Inv. | M-4 | ST-1 + CST-4 | 69 | 73 |
| 30 | 217 | Inv. | M-5 | ST-1 + CST-4 | 78 | 76 |
| 31 | 218 | Inv. | M-6 | ST-1 + CST-4 | 73 | 73 |
| 32 | 212 | Inv. | M-7 | ST-1 + CST-4 | 79 | 81 |
| 33 | 219 | Inv. | M-8 | ST-1 + CST-4 | 81 | 81 |
| 34 | 220 | Inv. | M-9 | ST-1 + CST-4 | 75 | 81 |
| 35 | 221 | Inv. | M-10 | ST-1 + CST-4 | 77 | 82 |
| 36 | 222 | Inv. | M-11 | ST-1 + CST-4 | 82 | 82 |
| 37 | 223 | Inv. | M-12 | ST-1 + CST-4 | 79 | 78 |
| 38 | 224 | Inv. | M-13 | ST-1 + CST-4 | 79 | 81 |
| 39 | 225 | Comp. | CM-1 | ST-1 + CST-4 | 47 | 57 |
| 40 | 226 | Comp. | CM-2 | ST-1 + CST-4 | 44 | 58 |
| 41 | 227 | Comp. | CM-3 | ST-1 + CST-4 | 62 | 71 |
| 42 | 228 | Comp. | CM-4 | ST-1 + CST-4 | 34 | 46 |
| 43 | 229 | Comp. | CM-5 | ST-1 + CST-4 | 13 | 10 |

Examples 23 and 24 in Table 8, and Examples 27–38 in Table 9, all of which contain couplers of the invention, have much better dye stability than any of the comparison examples. The following comparisons are of particular interest.

Comparison coupler CM-1 is identical to coupler M-9 of the invention except that CM-1 lacks the required oxygen atom linking the group $R_1$ to the PBI nucleus in Formula (1a). The dye stability of example 34, containing much better than that of Example 39, containing CM-1.

Comparison couplers CM-2 and CM-3 are a pyrazolo[2,3-b][1,2,4]triazole and a pyrazolo[3,2-c][1,2,4]triazole, respectively, that are used commercially in color photographic papers. In Table 8, Example 26, which contains CM-3, has poorer light stability than either of the examples of the invention in Table 8. Similarly, examples 40 and 41, which contain CM-2 and CM-3 respectively, have poorer light stability than any of the examples of the invention.

Comparison couplers CM-4 and CM-5 are examples of pyrazoloazole couplers of Formulas (A) and (B), respectively, and coupler M-1 of the invention is an example of a PBI coupler of Formula (1), in each of which $R_2$ is a methoxy group. Examples 42 and 43, which contain CM-4 and CM-5 respectively, have very poor dye stability, while example 27, which contains M-1, has excellent dye stability. This comparison illustrates the very different effect of the alkoxy group $R_2$ on light stability in the different coupler types.

It may also be observed, from the examples of our invention in Tables 7 and 8, that of the couplers of our invention, couplers M-7 through M-13, whose group $R_1$ is a secondary alkyl group (that is, branched at the carbon atom attached to the oxygen atom), provide generally better dye stability than couplers M-1 through M-6, whose group $R_1$ is not branched at the carbon atom attached to the oxygen atom. Thus, a preferred embodiment of the invention comprises a pyrazolobenzimidazole coupler of formula (1a) in which the group $R_1$ is an alkyl group in which the first carbon atom has no more than one hydrogen atom attached; that is, a secondary, tertiary or cyclic alkyl group.

The data in Table 10 illustrate the effect of diluting the oil phase of the coupler dispersion by adding additional coupler solvent. In this table, the amount of solvent in elements 212 and 223 is designated "1x" and the amount in elements 230 and 231 is designated "3x".

TABLE 10

| | | | | Solvent | Dye Stability | |
|---|---|---|---|---|---|---|
| Example | Element | Comp/Inv | Coup | Amount | from 1.0 | from 1.7 |
| 44 | 212 | Inv. | M-7 | 1x | 79 | 81 |
| 45 | 229 | Inv. | M-7 | 3x | 86 | 93 |
| 46 | 222 | Inv. | M-12 | 1x | 79 | 78 |
| 47 | 230 | Inv. | M-12 | 3x | 85 | 86 |

The data in Table 10 show that the light stability of the image dyes from the couplers of our invention can be improved even further by increasing the amount of coupler solvent in the dispersion.

The invention has been described in detail with particular reference to certain preferred embodiments thereof, but it will be understood that variations and modifications can be effected within the spirit and scope of the invention.

What is claimed is:

1. A photographic element comprising a support on which is coated at least one green-sensitized silver halide emulsion layer having associated therewith at least one magenta dye-forming coupler of Formula (1a) and at least one compound of Formula (2)

(1a)

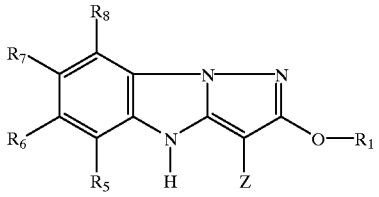

wherein:

$R_1$ is an alkyl group;

$R_5$, $R_6$, $R_7$, and $R_8$ each independently represent a hydrogen atom or a substituent;

Z is a hydrogen atom or a group that can be split off by the reaction of the coupler with an oxidized color-developing agent;

(2)

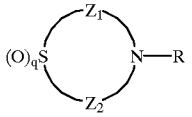

wherein:

$Z_1$ and $Z_2$ are alkylene groups of 1–3 carbon atoms;

R is an aryl or heterocyclic group, and q is 1 or 2.

2. The element of claim 1 in which $R_1$ is a secondary, tertiary, or cyclic alkyl group.

3. The element of claim 1 in which $R_5$, $R_6$, $R_7$, and $R_8$ each represent a hydrogen atom.

4. The element of claim 1 in which Z is a substituted alkylthio group.

5. The element of claim 4 in which the alkylthio group is substituted with a carboxy group.

6. The element of claim 1 in which $R_1$ is an alkyl group and A is a substituted alkylthio group.

7. The element of claim 1 in which the stabilizer is represented by Formula (3a)

(3a)

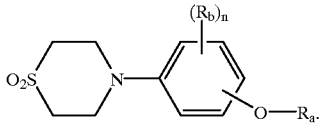

wherein:

$R_a$ is an alkyl group;

$R_b$ is an alkyl group, an alkoxy group, a primary or secondary amino group, or an amido group; and n is an integer from 0 to 4.

8. The element of claim 7 wherein n is 0.

9. The element of claim 1 wherein the amount of coupler of formula (1a) is 5 to 40 wt % of the total amount of couplers, stabilizers and coupler solvents in the green-sensitized silver halide emulsion layer.

10. The element of claim 1 wherein the amount of coupler of formula (1a) is 7 to 15 wt % of the total amount of couplers, stabilizers and coupler solvents in the green-sensitized silver halide emulsion layer.

11. A photographic element comprising a support on which is coated at least one blue-sensitive silver halide emulsion layer having associated therewith at least one yellow dye-forming coupler; at least one green-sensitive silver halide emulsion as described in claim 1; and at least one red-sensitive silver halide emulsion layer having associated therewith at least one cyan dye-forming coupler.

12. The element of claim 1 wherein the green-sensitized silver halide emulsion layer comprises at least 90 mole % silver chloride.

13. The element of claim 1 wherein the support is a reflective support.

14. The element of claim 1 wherein the weight ratio of solvent to coupler is in excess of 1.

15. The element of claim 12 wherein the weight ratio of solvent to coupler is in excess of 2.

16. The element of claim 1 wherein the coupler of formula (1a) is selected from the following:

M-1

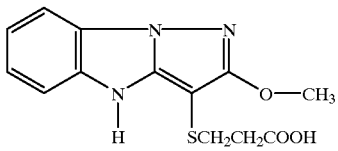

-continued

M-2

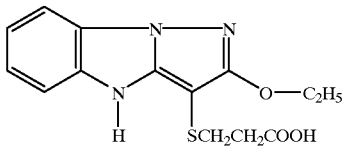

M-3

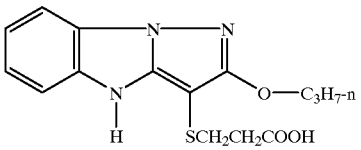

M-4

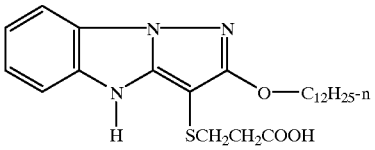

M-5

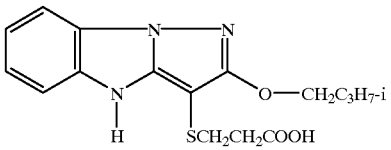

M-6

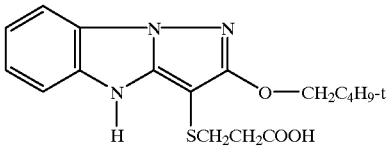

M-7

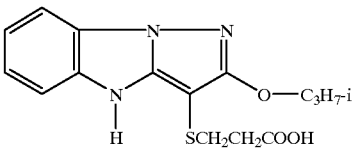

M-8

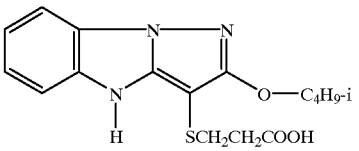

M-9

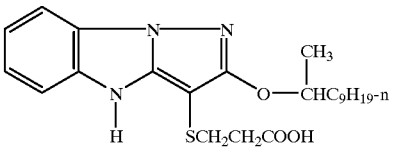

M-10

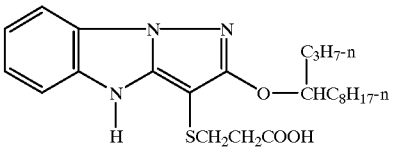

-continued

M-11

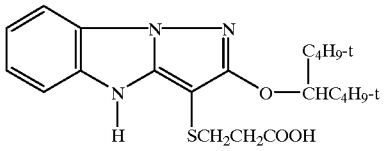

M-12

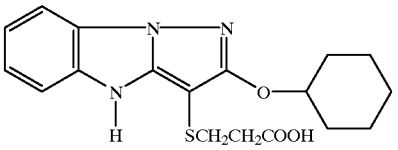

and

M-13

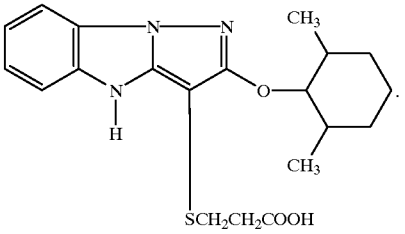

17. The element of claim 6 wherein the compound of Formula (a3) is selected from the following:

ST-1

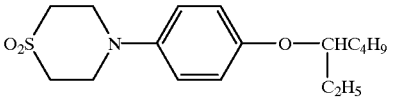

ST-2

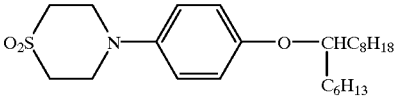

and

ST-3

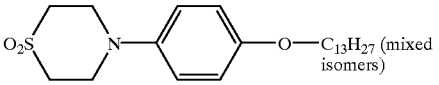

18. The element of claim 1 in which said at least one green-sensitized silver halide emulsion layer also has associated therewith a secondary stabilizer represented by formula (4):

(4)

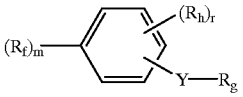

wherein:

each $R_f$ is an independently selected alkyl or alkoxy group having 1–32 carbon atoms and m is 1–4;

each $R_h$ is an independently selected substituent and r is 0–4;

Y is —$NHSO_2$—or —$SO_2NH$—; and $R_g$ is an alkyl group of 1–16 carbon atoms.

19. The element of claim 1 in which said at least one green-sensitized silver halide emulsion layer also has associated therewith a secondary stabilizer represented by formula (5):

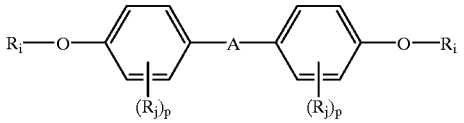

(5)

wherein:

each $R_i$ independently represents a hydrogen atom, an alkyl group, an alkenyl group or an aryl group;

each $R_j$ independently represents a halogen atom, an alkyl group, an alkenyl group an alkoxy group, an aryl group, an aryloxy group, an alkylthio group, an aryl thio group, an acyl group, an an acylamino group, a sulfonyl group, a sulfonamide group or a hydroxy group;

each p is, individually an integer of 0 to 4; and

A represents an alkylene group having 1 to 6 carbon atoms in its linear structure.

* * * * *